US010215195B2

(12) United States Patent
Frampton

(10) Patent No.: US 10,215,195 B2
(45) Date of Patent: Feb. 26, 2019

(54) VIBRATION ISOLATION SYSTEM FOR A FAN MOTOR

(71) Applicant: Fanimation, Inc., Zionsville, IN (US)

(72) Inventor: Thomas C. Frampton, Carmel, IN (US)

(73) Assignee: Fanimation, Inc., Zionsville, IN (US)

( * ) Notice: Subject to any disclaimer, the term of this patent is extended or adjusted under 35 U.S.C. 154(b) by 374 days.

(21) Appl. No.: 15/045,392

(22) Filed: Feb. 17, 2016

(65) Prior Publication Data

US 2016/0238035 A1 Aug. 18, 2016

Related U.S. Application Data

(60) Provisional application No. 62/117,210, filed on Feb. 17, 2015.

(51) Int. Cl.

| | |
|---|---|
| ***F04D 29/66*** | (2006.01) |
| ***F04D 29/32*** | (2006.01) |
| ***F04D 25/08*** | (2006.01) |

(52) U.S. Cl.

CPC ..... *F04D 29/668* (2013.01); *F04D 25/088* (2013.01); *F04D 29/322* (2013.01); *F04D 29/329* (2013.01); *F05D 2260/96* (2013.01)

(58) Field of Classification Search

CPC .... F04D 25/088; F04D 29/329; F04D 29/322; F04D 29/668; F05D 2260/96

See application file for complete search history.

(56) References Cited

U.S. PATENT DOCUMENTS

| | | | | |
|---|---|---|---|---|
| 2,678,104 A * | 5/1954 | Davis | F04D 29/382 | 416/134 R |
| 4,511,310 A * | 4/1985 | Pearce | F04D 29/646 | 416/134 R |
| 5,030,068 A * | 7/1991 | Jacobs | F04D 29/626 | 417/363 |
| 6,364,612 B1 * | 4/2002 | Tseng | F04D 25/088 | 416/133 |
| 6,505,807 B1 * | 1/2003 | Nolting | B60H 1/00521 | 248/638 |
| 6,872,053 B2 * | 3/2005 | Bucher | F04D 25/088 | 403/302 |

* cited by examiner

*Primary Examiner* — Ninh H. Nguyen

(74) *Attorney, Agent, or Firm* — Maginot, Moore & Beck LLP

(57) ABSTRACT

A hub assembly for a fan reduces transmission of vibrations between the fan motor and the fan blades. The hub assembly comprises a motor assembly, a hub, and a plurality of resilient members. The motor assembly includes a motor and a motor housing surrounding the motor, and the motor is configured to rotate the motor housing during operation. The hub is supported on the motor housing by a plurality of fasteners. The resilient members are at least partially interposed between the hub and the motor housing, and each resilient member of the plurality of resilient members surrounds a portion of a corresponding fastener of the plurality of fasteners.

10 Claims, 8 Drawing Sheets

VIBRATION ISOLATION SYSTEM FOR A FAN MOTOR

CLAIM OF PRIORITY

This application claims priority to U.S. Provisional Application Ser. No. 62/117,210 entitled "Vibration Isolation System for a Fan Motor," filed Feb. 17, 2015, the disclosure of which is hereby incorporated herein by reference in its entirety.

TECHNICAL FIELD

This disclosure relates generally to fans, and, more particularly, to external rotor ceiling fans.

BACKGROUND

Ceiling fans are fans mounted from the ceiling of a room in a building or from the roof of a covered patio, or the like, and have a housing generally supported from a pipe or pole attached to the ceiling. Ceiling fans typically include a motor coupled to a plurality of fan blades to rotate the fan blades. The rotating fan blades provide airflow, enabling the ceiling fan to provide an energy efficient means of cooling or ventilating an area.

Conventional ceiling fans typically include one of two different types of motors. The first, known in the art as an internal rotor motor is configured such that the rotor is arranged inside the stator and the fan housing and is connected to a shaft extending outside the housing. The shaft is connected to the fan blades, typically through a flywheel and fan blade holders.

The second type of ceiling fan motor is known as an external rotor motor. In an external rotor ceiling fan, the external housing of the motor is the rotor or is directly attached to the rotor so that the external housing of the fan rotates with the rotor. The external housing spins around the stator, and fan blades attached to the rotor, generally by fan blade holders, rotate to generate airflow.

During operation of a fan, vibrations are produced by the rotating fan blades and by the motor. These vibrations are transferred between the blades and the motor through the connection therebetween. In some instances, the vibrations can become significant, resulting in additional noise and, in extreme cases, damage to the fan or motor.

One solution to reduce vibrations is to provide a rubber pad between the rotor and the fan blades or the fan blade holders. This rubber pad, however, provides only minimal reduction in the vibrations since the pad is connected directly to both the fan blade holders and the motor. Additionally, the screws connecting the motor housing to the fan blade holders are directly connected to the motor housing and the fan blade holders, and therefore vibrations are transferred between the motor and fan blades through the screws.

It would thus be desirable to provide a system to reduce vibrations in external rotor ceiling fans.

SUMMARY

In one embodiment, a hub assembly for a fan reduces transmission of vibrations between the fan motor and the fan blades. The hub assembly comprises a motor assembly, a hub, and a plurality of resilient members. The motor assembly includes a motor and a motor housing surrounding the motor, and the motor is configured to rotate the motor housing during operation. The hub is supported on the motor housing by a plurality of fasteners. The resilient members are at least partially interposed between the hub and the motor housing, and each resilient member of the plurality of resilient members surrounds a portion of a corresponding fastener of the plurality of fasteners.

In some embodiments, each of the plurality of fasteners includes a head portion and a shaft portion and the hub includes a first side facing said motor housing and a second side facing away from said motor housing. Each resilient member includes (i) a first portion interposed between the motor housing and the first side of the hub and surrounding the shaft portion of the corresponding fastener, and (ii) a second portion interposed between the head portion of the corresponding fastener and the second side of the hub.

In another embodiment of the hub assembly, the second side of the hub defines a plurality of recesses and the hub defines a plurality of openings. Each of the plurality of openings extends from a corresponding recess of the plurality of recesses to the first side of the hub. Each of the plurality of recesses receives the second portion of one of the plurality of resilient members and the head portion of one of the plurality of fasteners.

In a further embodiment of the hub assembly, each resilient member includes a third portion connecting the first portion and the second portion, and the third portion is located in a corresponding opening of the plurality of openings.

In yet another embodiment of the hub assembly, each of the plurality of fasteners includes a head portion and a shaft portion, and the hub includes a first side facing said motor housing and a second side facing away from said motor housing. The hub assembly further comprises a plurality of resilient spacers, and each resilient spacer is interposed between the head portion of a respective fastener and the second side of the hub.

In some embodiments, the second side of the hub defines a plurality of recesses and the hub defines a plurality of openings, with each opening of the plurality of openings extending from a corresponding recess of the plurality of recesses to the first side of the hub. Each of the plurality of recesses receives one of the plurality of resilient spacers and the head portion of one of the plurality of fasteners.

In one embodiment, each of the plurality of resilient spacers includes a first annular portion and a second annular portion, the first annular portion having a greater outer diameter than the second annular portion.

In a further embodiment, the second annular portion of each resilient spacer is positioned in a corresponding opening of the plurality of openings.

In yet another embodiment of the hub assembly, the plurality of resilient members are formed of an elastomeric material.

In some embodiments of the hub assembly, the hub defines a plurality of threaded openings configured for mounting a plurality of fan blades to the hub such that each of the plurality of fan blades is mounted to two of the plurality of threaded openings that are adjacent and on opposite sides of the resilient members.

In another embodiment, a vibration isolation system for a ceiling fan includes a hub and a plurality of resilient members. The hub is hub configured to be supported on a motor housing of a motor assembly by a plurality of fasteners. The resilient members are at least partially interposed between the hub and the motor housing, and each resilient member of the plurality of resilient members surrounds a portion of a corresponding fastener of the plurality of fasteners.

In one embodiment of the vibration isolation system, each of the plurality of fasteners includes a head portion and a shaft portion and the hub includes a first side facing said motor housing and a second side facing away from said motor housing. Each resilient member includes (i) a first portion interposed between the motor housing and the first side of the hub and surrounding the shaft portion of the corresponding fastener, and (ii) a second portion interposed between the head portion of the corresponding fastener and the second side of the hub.

In a further embodiment of the vibration isolation system, the second side of the hub defines a plurality of recesses and the hub defines a plurality of openings, each of the plurality of openings extending from a corresponding recess of the plurality of recesses to the first side of the hub. Each of the plurality of recesses receives the second portion of one of the plurality of resilient members and the head portion of one of the plurality of fasteners.

In another embodiment, each resilient member includes a third portion connecting the first portion and the second portion, the third portion being located in a corresponding opening of the plurality of openings.

In yet another embodiment of the vibration isolation system, each of the plurality of fasteners includes a head portion and a shaft portion and the hub includes a first side facing the motor housing and a second side facing away from the motor housing. The vibration isolation system further comprises a plurality of resilient spacers, and each resilient spacer is interposed between the head portion of a respective fastener and the second side of the hub.

In some embodiments of the vibration isolation system, the second side of the hub defines a plurality of recesses and the hub defines a plurality of openings. Each opening of the plurality of openings extends from a corresponding recess of the plurality of recesses to the first side of the hub. Each of the plurality of recesses receives one of the plurality of resilient spacers and the head portion of one of the plurality of fasteners.

In another embodiment, each of the plurality of resilient spacers includes a first annular portion and a second annular portion, the first annular portion having a greater outer diameter than the second annular portion.

In a further embodiment according to the disclosure, a fan comprises a motor assembly, a hub, a plurality of resilient members, and a plurality of fan blades supported by the hub. The motor assembly includes a motor and a motor housing surrounding the motor, and the motor is configured to rotate the motor housing during operation. The hub is supported on the motor housing by a plurality of fasteners. The plurality of resilient members are at least partially interposed between the hub and the motor housing, and each resilient member of the plurality of resilient members surrounds a portion of a corresponding fastener of the plurality of fasteners.

In some embodiments of the fan, each of the plurality of fasteners includes a head portion and a shaft portion and the hub includes a first side facing said motor housing and a second side facing away from said motor housing. Each resilient member includes (i) a first portion interposed between the motor housing and the first side of the hub and surrounding the shaft portion of the corresponding fastener, and (ii) a second portion interposed between the head portion of the corresponding fastener and the second side of the hub.

In yet another embodiment of the fan, each of the plurality of fasteners includes a head portion and a shaft portion and the hub includes a first side facing said motor housing and a second side facing away from said motor housing. The fan assembly further comprises a plurality of resilient spacers, with each resilient spacer being interposed between the head portion of a respective fastener and the second side of the hub.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
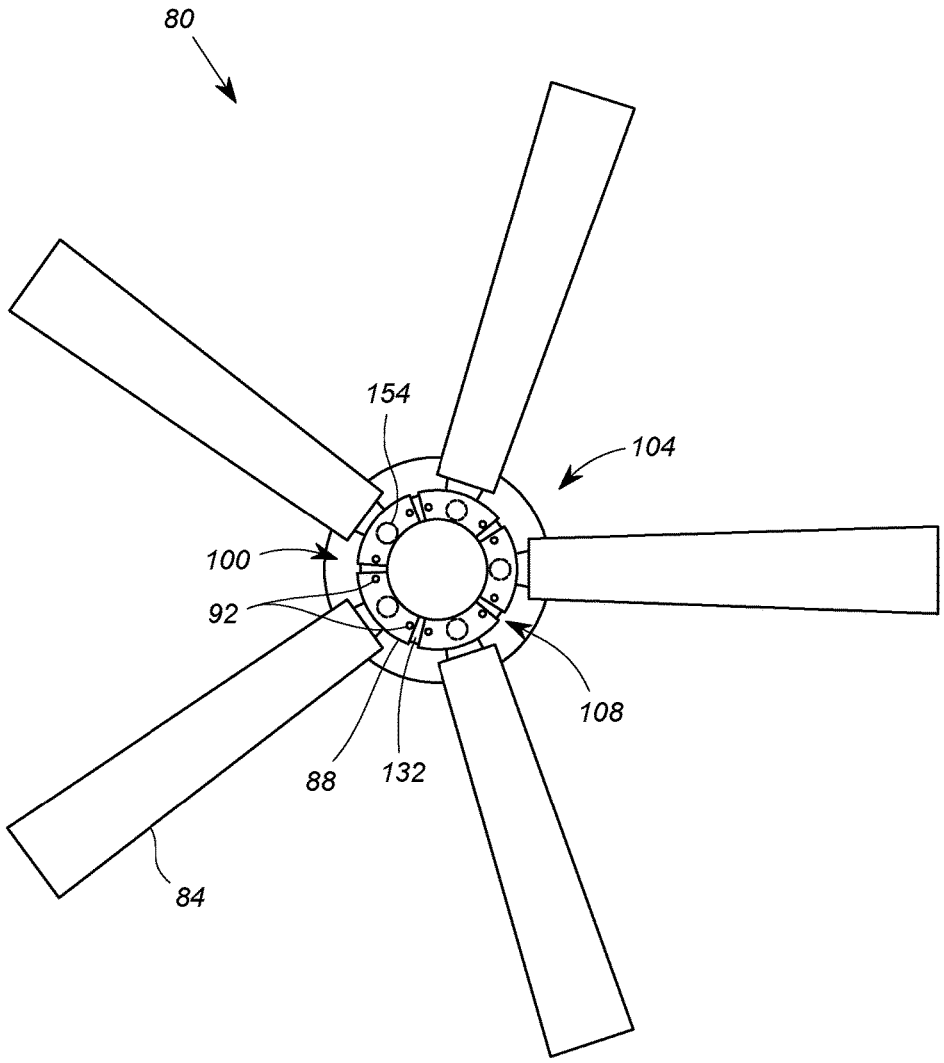
FIG. 1 is a bottom view of a ceiling fan having a hub assembly with a vibration isolation system according.

FIG. 1 illustrates a bottom view of a ceiling fan 80 having a hub assembly 100 according to the disclosure. The ceiling fan includes a plurality of blades 84, each of which is attached to a corresponding blade mount 88. The blade mounts 88 are attached to a hub plate 132, described in detail below, of the hub assembly 100 using two fasteners 92.

Figure 2:
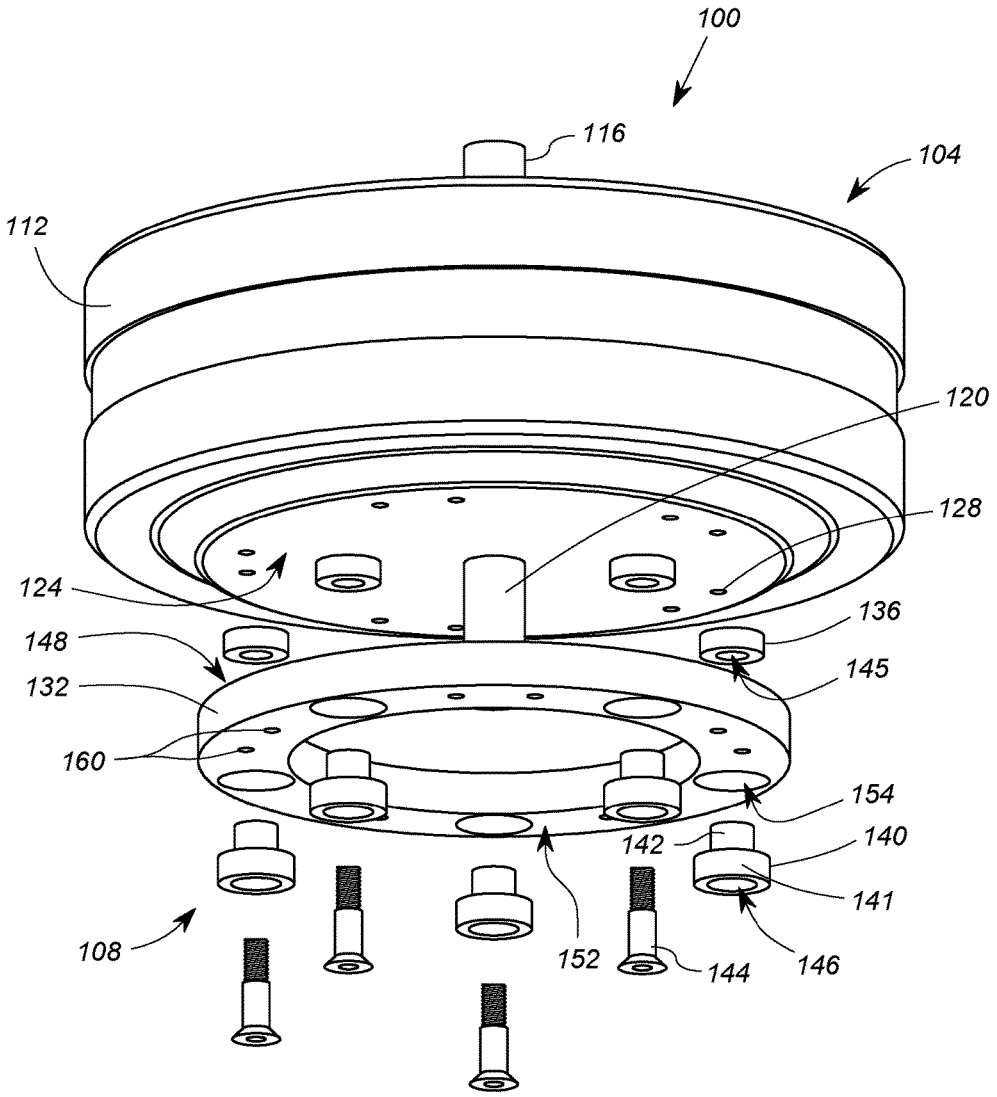
FIG. 2 is an exploded perspective view of a ceiling fan motor and the vibration isolation system of the ceiling fan of FIG. 1.

FIG. 2 illustrates an exploded view of the hub assembly 100, which includes a ceiling fan motor 104 and a vibration isolation system 108. The ceiling fan motor 104 includes an external housing 112, out of which a mounting shaft 116 extends upwardly and a stationary shaft 120 extends downwardly. In some embodiments, the mounting shaft 116 and the stationary shaft 120 are formed integrally as a single shaft extending through the motor housing 112. The mounting shaft 116 is configured to be attached to a mounting structure (not shown), for example a ceiling, to mount the fan 80 to the mounting structure.

The stationary shaft 120 extends downwardly from the housing 112 and is configured to receive stationary components, for example a light, a control switch, and/or an ornamental structure. The motor 104 has a stator (not shown) positioned within the housing 112, while the housing 112 is configured to act as the rotor for the motor 104, such that the entire housing 112 rotates when the stator is activated. The housing 112 includes a bottom surface 124 having a plurality of threaded bores 128.

The vibration isolation system 108 includes a hub plate 132, a plurality of resilient upper spacers 136, a plurality of resilient lower spacers 140, and a plurality of fasteners 144. The upper spacers 136 are substantially annular in shape. The lower spacers 140 have an annular lower section 141 and an annular upper section 142. The outer diameter of the lower section 141 is greater than the outer diameter of the upper section 142. Each of the upper and lower spacers 136, 140 has a central opening 145, 146, respectively, sized to enable a corresponding fastener 144 to extend through the central opening 145 of each of upper spacer 136 and the central opening 146 of each associated lower spacer 140. In one embodiment, the resilient spacers 136, 140 are formed of an elastomeric material, for example rubber. In other embodiments, other desired resilient materials are used for the spacers 136, 140.

The hub plate 132 is substantially annular, and is formed of a rigid material, for example steel. In some embodiments, the hub plate 132 is formed of other metals, for example aluminum, brass, or iron, while in other embodiments the hub plate 132 is formed of a plastic or a hardened rubber material. In one embodiment, the hub is not formed as a plate, but is instead a toroidal bar or another desired shape.

Figure 3:
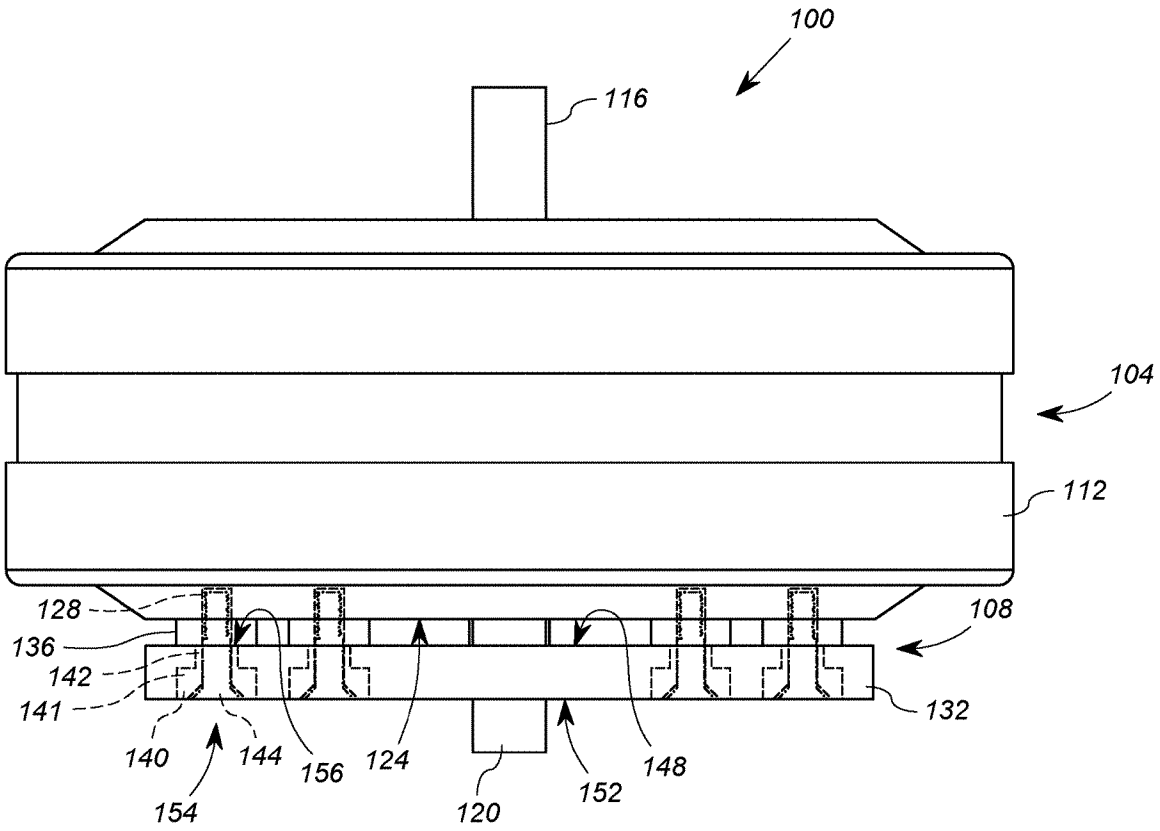
FIG. 3 is a side view of the ceiling fan motor and vibration isolation system of FIG. 2.

The hub plate 132 has an upper surface 148 and a lower surface 152. The lower surface 152 defines a plurality of recesses 154 and a plurality of openings 156 (FIG. 3) extending through the hub plate 132 from the recesses 154 to the upper surface 148. The recesses 154 have a shape that corresponds to the shape of the lower section 141 of the lower spacer 140, and the openings 156 have a shape that corresponds to the upper section of the lower spacer 140. As a consequence, the recesses 154 and openings 156 each accommodate and fit the respective portions 141, 142 of the lower spacers 140 with little or no play therebetween. Each of the openings 156 is configured to align with one of the plurality of threaded bores 128 in the lower surface 124 of the motor housing 112.

The lower surface 152 of the hub plate 132 further includes a plurality of threaded holes 160. The threaded holes 160 are arrayed around the hub plate 132 and are configured to receive blade fasteners 92 (FIG. 1), which fasten the fan blades 84, or, in the embodiment illustrated in FIG. 1, the blade mounting brackets 88 to which the fan blades 84 are connected, to the hub plate 132. As shown in FIG. 1, each blade mounting bracket 88 is configured to attach to two fasteners 92 and the corresponding threaded holes 160 that are on opposite sides of a corresponding one of the recesses 154. In various embodiments, the threaded holes 160 (FIG. 3) can be arranged in any desired pattern so that a suitable number of fan blades 84 or blade mounting brackets 88 can be attached to the hub plate 132.

In some embodiments, the hub plate 132 is substantially hollow, and may not include a uniform upper surface. In such an embodiment, the openings and the threaded holes are surrounded by a thin sleeve, and the hub may include, for example, ribs between the sleeves to provide structural support for the hub plate 132.

FIG. 2 illustrates the hub assembly 100 with the motor 104 and vibration isolation system 108 in an assembled state. The lower spacers 140 fit within the recesses 154 and openings 156 of the hub plate 132. The upper spacers 136 are positioned between the upper surface 148 of the hub plate 132 and the lower surface 124 of the motor housing 112 so that each upper spacer 136 aligns with one of the openings 156 of the hub plate 132. The fasteners 144 extend through the central openings of the upper and lower spacers 136, 140 and engage the threaded bores 128 in the motor housing 112 to secure the hub plate 132 to the motor housing 112.

During operation of the fan 100 of FIG. 1, the stator (not shown) of the motor 104 is energized, resulting in rotation of the motor housing 112 and the hub plate 132 about the central axis of the motor housing 112 and hub plate 132. The fan blades 84 spin about the central axis of the fan 100 along with the motor housing 112 and hub plate 132, producing a flow of air.

As the fan blades 84 rotate, oscillating vibrations are produced in the blades 84 and transferred via the blade mounting brackets 88 to the hub plate 132. Additionally, operation of the motor 104 introduces vibrations in the motor housing 112. The transfer of vibrations between the motor housing 112 and the hub plate 132 is damped in the radial direction (horizontal in the view of FIG. 3) by the resilient lower spacers 140, which elastically deform within the recesses 154 and openings 156 to isolate the hub plate 132 from the fasteners 144.

In the axial direction (vertical in the view of FIG. 3), the resilient upper spacers 136 elastically deform to dampen vibrations and movement between the upper surface 148 of the hub plate 132 and the lower surface 124 of the motor housing 112, while the lower section 141 of the lower spacer 140 deforms elastically to dampen axial vibrations between the fastener 144 and the hub plate 132. As a result, the transfer of vibrations and movement between the motor 104 and the fan blades 84 is greatly reduced.

Figure 4:
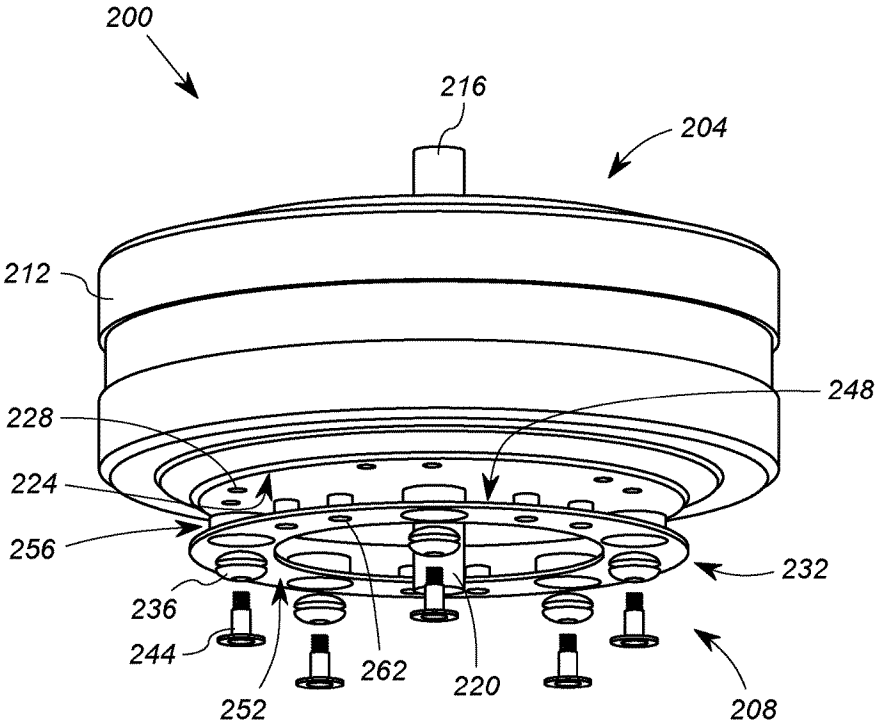
FIG. 4 is an exploded perspective view of a ceiling fan motor having another vibration isolation system.

FIG. 4 illustrates an exploded view of another embodiment of a hub assembly 200 configured to be used in the ceiling fan 80 in place of the hub assembly 100 described above. The hub assembly 200 includes a ceiling fan motor 204 and a vibration isolation system 208. The ceiling fan motor 204 includes an external housing 212, out of which a mounting shaft 216 extends upwardly and a stationary shaft 220 extends downwardly. Similarly to the hub assembly 100, the mounting shaft 216 and the stationary shaft 220 may be formed integrally as a single shaft extending through the motor housing 212. In any event, the mounting shaft 216 is configured to be attached to a mounting structure (not shown), for example a ceiling, to mount the ceiling fan 80.

The stationary shaft 220 extends downwardly from the housing 212 and is configured to receive stationary components, for example a light, a control switch, and/or an ornamental structure. The motor 204 has a stator (not shown) positioned within the housing 212, while the housing 212 is configured to act as the rotor for the motor 204, such that the entire housing 212 rotates when the stator is activated. The housing 212 further includes a bottom surface 224 having a plurality of threaded bores 228.

The vibration isolation system 208 includes a hub plate 232, a plurality of resilient grommets 236 and a plurality of fasteners 244. The hub plate 232 is an annular substantially flat plate, and is formed of a rigid material, for example steel. In some embodiments, the hub plate 232 is formed of other metals, for example aluminum, brass, or iron, while in other embodiments the hub plate 232 is formed of a hardened plastic or rubber material. The hub plate 232 has an upper surface 248 and a lower surface 252. A plurality of projections 256 extend upwardly from the upper surface 248, each of which defines an opening 260. The projections 256 are cylindrical and define an interior that receives at least a portion of the grommet 236. Further detail regarding the interaction between the projection 256 and the grommets 236 is presented below in connection with the description of FIG. 5. Each of the openings 260 is configured to align with one of the plurality of threaded bores 228 in the lower surface 224 of the motor housing 212.

The lower surface 252 of the hub plate 232 further includes a plurality of threaded holes 262. The threaded holes 262 are arrayed around the hub plate 232 and are configured to receive blade fasteners 92, which fasten blade mounting brackets 88, to which fan blades 84 are connected, to the hub plate 232. The threaded holes 262 can be arranged in any desired pattern so that a suitable number of fan blades 84 or blade brackets 88 can be attached to the hub plate 232.

Figure 5:
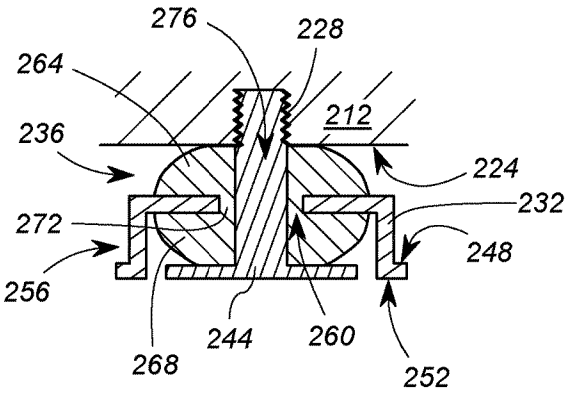
FIG. 5 is a cross-sectional detail view of a grommet, a fastener, and a hub of the vibration isolation system of FIG. 4.

As shown more clearly in the detail view of FIG. 5, the grommets 236 have an upper region 264, a lower region 268, a middle region 272, and a central opening 276. The central opening 276 is sized to allow the fastener 244 to fit into the central opening 276 of the grommet 236. The middle region 272 of the grommet 234 has an outer circumference that is substantially the same size as the inner circumference of the opening 260 in the projection 256. The upper and lower regions 264, 268 are wider than the middle region 272 so that a portion of the upper and lower regions 264, 268 cover the surfaces of the projection 256 around the opening 260. In one embodiment, the grommets 236 are formed of an elastomeric material, for example rubber, though other desired resilient materials are used in other embodiments.

In the embodiment described, the upper and lower regions 264, 268 have an outer diameter that is between approximately 1.5 and 3 times the outer diameter of the middle region 272. Additionally, the upper and lower regions 264, 268 have an axial thickness than is between 2 and 3 times the axial thickness of the middle region 272. In the illustrated embodiment, the grommet 234 forms a round resilient member with an annular channel defined between the upper and lower regions 264, 268 such that the annular channel circumferentially surrounds the middle region 272.

Figure 6:
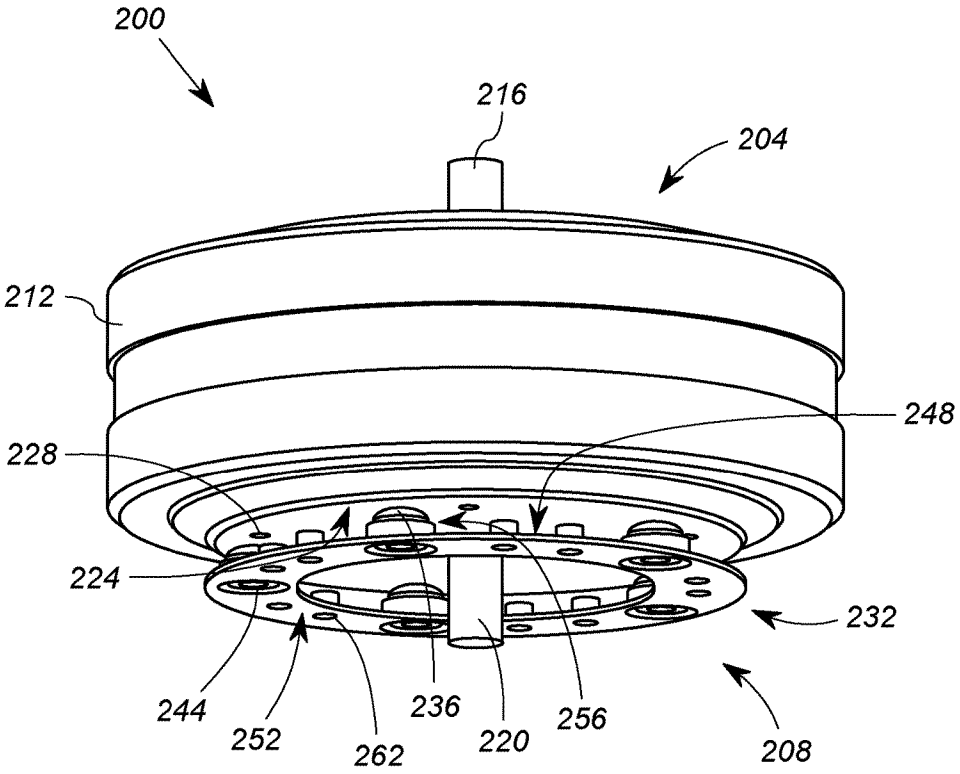
FIG. 6 is a side view of the ceiling fan motor and vibration isolation system of FIG. 4.

FIGS. 5 and 6 illustrate hub assembly 200 with the motor 204 and vibration isolation system 208 in an assembled state. The lower region 268 of the grommets 236 fit in a cavity defined within the projections 256 of the hub plate 232. The upper region 264 is positioned between the upper surface of the projection 232 and the lower surface 224 of the motor housing 212 in such a way that the central opening of each grommet 236 aligns with one of the openings 228 of the motor housing 212. The fasteners 244 extend through the central openings 276 of the grommets 236 and engage the threaded bores 228 in the motor housing 212 to secure the hub plate 232 to the motor housing 212.

During operation of the fan 80 of FIG. 1 with the hub assembly 100 installed, the stator (not shown) of the motor 204 is energized, resulting in the motor housing 212 and the hub plate 232 rotating. The fan blades 84 attached to the threaded holes 262 of the hub plate 232 via the blade mounting brackets 88 and the blade fasteners 92 spin with the motor housing 212 and hub plate 232, producing a flow of air.

As the fan blades 84 rotate, oscillating vibrations are produced in the fan blades 84 and transferred to the hub plate 232. Additionally, the operation of the motor 204 introduces vibrations in the motor housing 212. The vibrations are damped in the radial direction (horizontal in the views of FIGS. 5 and 6) primarily by the middle regions 272 of the grommets 236, which elastically deform within the openings 260 to dampen the transfer of radial vibrations between the fasteners 244 and the hub plate 232. In the axial direction (vertical in the views of FIGS. 5 and 6), the upper and lower regions 264, 268 of the grommets 236 elastically deform to dampen axial vibrations and movement between the hub plate 232 and the motor housing 212 and between the hub plate 232 and the fasteners 244. As a result, the transfer of vibrations and movement between the motor 204 and the fan blades 84 is greatly reduced.

Figure 7:
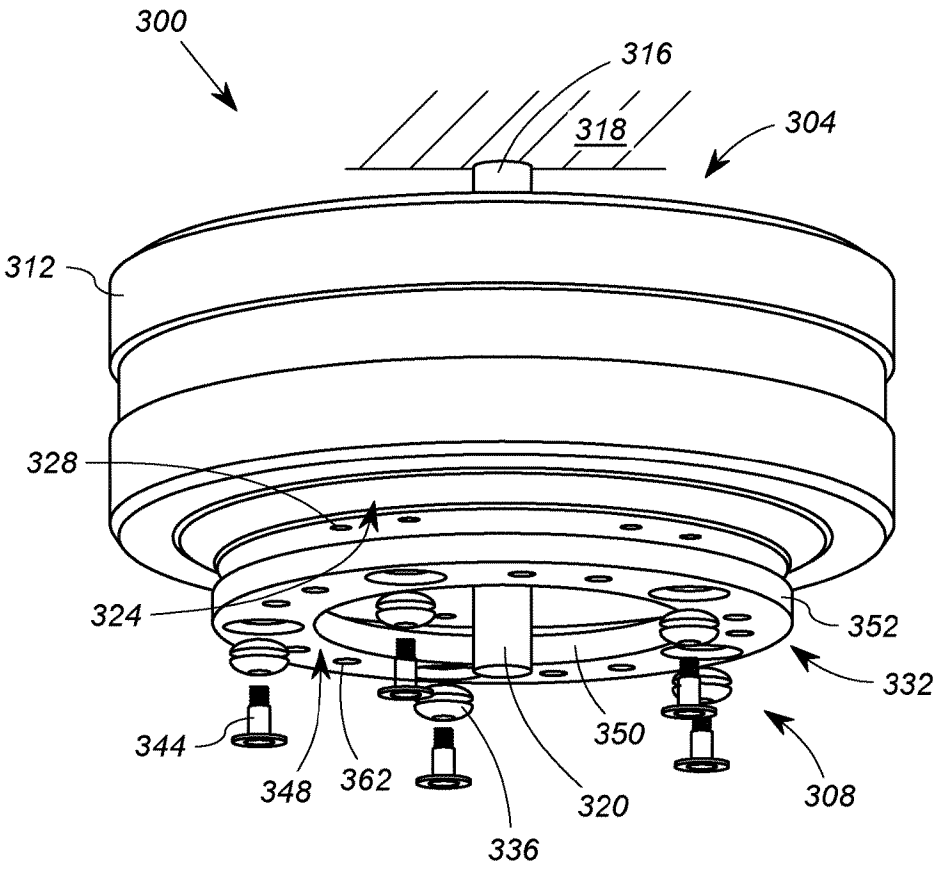
FIG. 7 is an exploded perspective view of a ceiling fan motor and another embodiment of a vibration isolation system.
Figure 9:
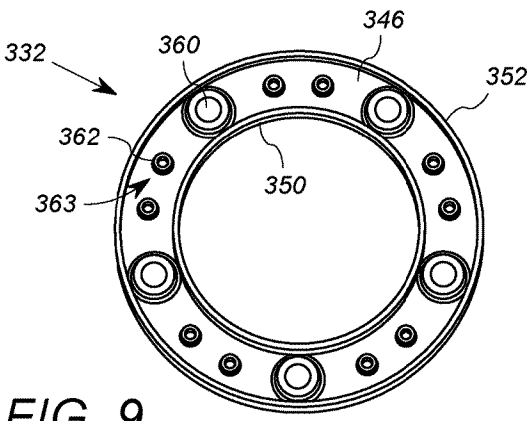
FIG. 9 is a top view of the hub of the vibration isolation system of FIG. 7.
Figure 8:
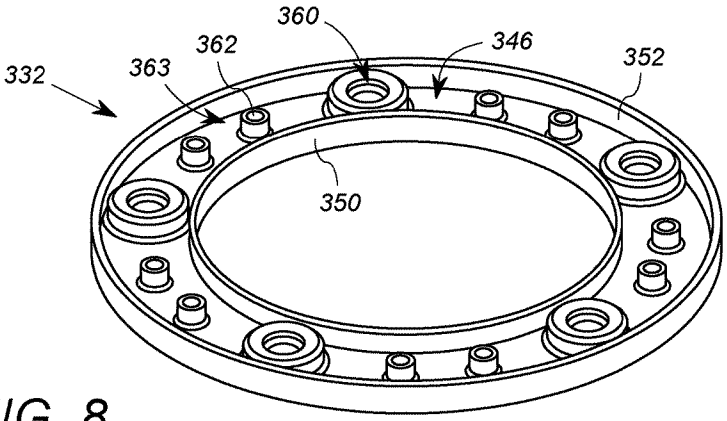
FIG. 8 is a top perspective view of a hub of the vibration isolation system of FIG. 7.
Figure 11:
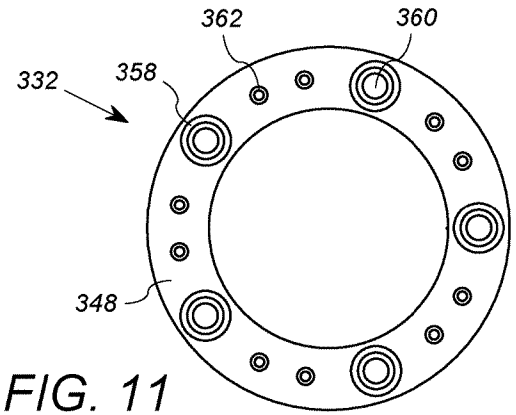
FIG. 11 is a bottom view of the hub of the vibration isolation system of FIG. 7.
Figure 10:
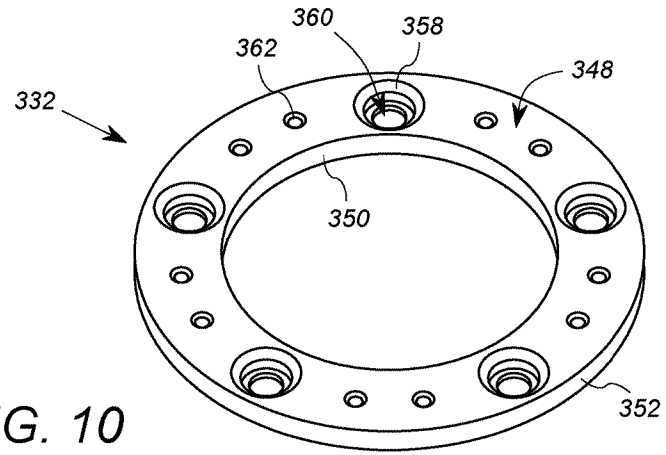
FIG. 10 is a bottom perspective view of the hub of the vibration isolation system of FIG. 7.

FIG. 7 illustrates an exploded view of another embodiment of a hub assembly 300 that may be used in the ceiling fan 80 of FIG. 1 in place of the hub assembly 100. The hub assembly 300 includes a ceiling fan motor 304 and a vibration isolation system 308. The ceiling fan motor 304 includes an external housing 312, out of which a mounting shaft 316 extends upwardly and a stationary shaft 320 extends downwardly. The mounting shaft 316 is configured to be attached to a mounting structure (not shown), for example a ceiling 318, to mount the ceiling fan 80. The stationary shaft 320 extends downwardly from the housing 312 and is configured to receive stationary components, for example a light, a control switch, and/or an ornamental structure. The motor 304 has a stator (not shown) positioned within the housing 312, while the housing 312 is configured to act as the rotor for the motor 304, such that the entire housing 312 rotates when the stator is activated. The housing 312 further includes a bottom surface 324 having a plurality of threaded bores 328.

The vibration isolation system 308 includes a hub plate 332, a plurality of resilient grommets 336 and a plurality of fasteners 344. As illustrated in the views of FIGS. 8-11, the hub plate 332 is an annular plate, and is formed of a rigid material, for example steel, aluminum, brass, iron, hardened plastic, or rubber material. The hub plate 332 has an upper surface 346 and a lower surface 348. An inner wall 350 and an outer wall 352 extend upwardly from the inner edge and the outer edge, respectively, of the hub plate 332.

A plurality of projections 356 extend upwardly from the upper surface 346, each of which includes an opening 360. Each of the projections 356 is generally cylindrical and is sized to receive at least a portion of the corresponding grommet 336. Further detail regarding the interaction of the grommets 336 and the corresponding projections 356 is provided further below in connection with the description of FIG. 12.

As shown in FIGS. 8-11, the lower surface 348 includes a beveled portion 358 at the periphery of each of the projections 356. The beveled portion 358 provides additional clearance between the head of the fasteners 344 and the hub plate 332. Thus, as the fasteners 344 and/or the hub plate 332 vibrates, the likelihood of the head of the fasteners 344 contacting the hub plate 332 is reduced. Each of the openings 360 is configured to align with one of the plurality of threaded bores 328 in the lower surface 324 of the motor housing 312.

The hub plate 332 further includes a plurality of cylindrical projections 363 arrayed around the hub plate 332 extending upwardly from the upper surface 346. Each cylindrical projection 363 includes a threaded hole 362 opening to the lower surface 348. The threaded holes 362 are configured to receive blade fasteners such as the blade fasteners 92 of FIG. 1 to fasten the blade mounting brackets 88 and the fan blades 84 to the hub plate 332. The threaded holes 362 can be arranged in any desired pattern so that a suitable number of fan blades 84 and/or blade mounting brackets 88 can be attached to the hub plate 332.

Figure 12:
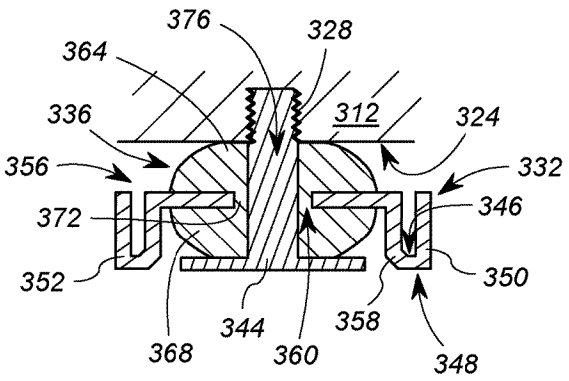
FIG. 12 is a cross-sectional detail view of a grommet, a fastener, and a hub of the vibration isolation system of FIG. 7.

As shown more clearly in the detail view of FIG. 12, the grommets 336 have an upper region 364, a lower region 368, a middle region 372, and a central opening 376. The central opening 376 is sized to allow the fastener 344 to fit into the central opening 376 of the grommet 336. The middle region 372 of the grommet 334 has an outer circumference that is substantially the same size as the inner circumference of the opening 360 in the projection 356. The upper and lower regions 364, 368 are wider than the middle region 372 so that a portion of the upper and lower regions 364, 368 cover the surfaces of the projection 356 around the opening 360. In one embodiment, the grommets 336 are formed of an elastomeric material, for example rubber, though other desired resilient materials are used in other embodiments.

In the embodiment described, the upper and lower regions 364, 368 have an outer diameter that is between approximately 1.5 and 3 times the outer diameter of the middle region 372. Additionally, the upper and lower regions 364, 368 have an axial thickness than is between 2 and 3 times the axial thickness of the middle region 372. In the illustrated embodiment, the grommet 334 forms a round resilient member with an annular channel defined between the upper and lower regions 364, 368 such that the annular channel circumferentially surrounds the middle region 372.

Figure 13:
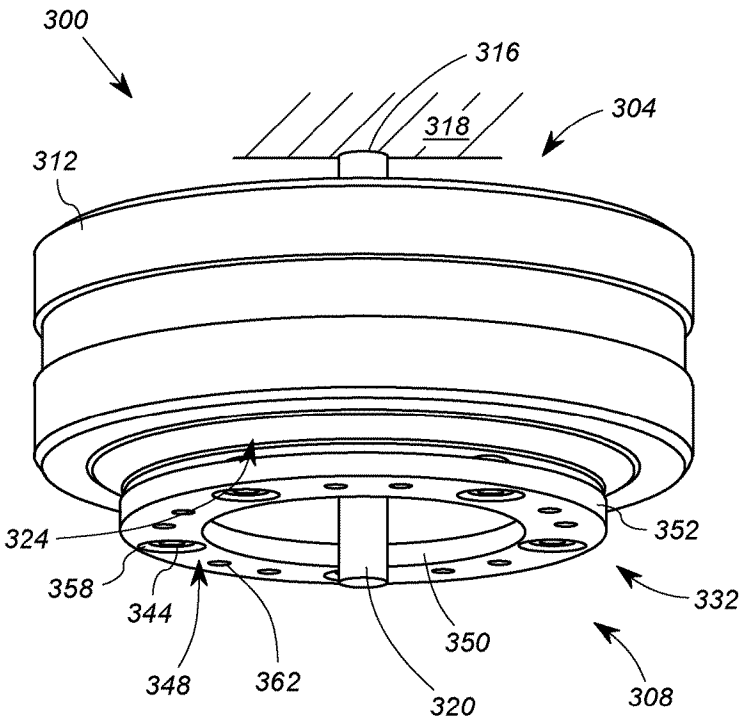
FIG. 13 is a side perspective view of the ceiling fan motor and vibration isolation system of FIG. 7.

FIGS. 12 and 13 illustrate the hub assembly 300 with the motor 304 and vibration isolation system 308 in an assembled state. The lower region 368 of each of the grommets 336 fits in a corresponding cavity defined within one of the projections 356 of the hub plate 332. The upper region 364 is positioned between the upper surface of the projection 332 and the lower surface 324 of the motor housing 312 in such a way that the central opening 376 of each grommet 336 aligns with a corresponding one of the openings 328 of the motor housing 312. A fastener 344 extends through the central opening 376 of each grommet 336 and engages the corresponding threaded bore 328 in the motor housing 312 to secure the hub plate 332 to the motor housing 312.

During operation of the fan 80 of FIG. 1 with the hub assembly 300 installed, the stator (not shown) of the motor 304 is energized, resulting in the motor housing 312 and the hub plate 332 rotating. The fan blades 84 attached to the threaded holes 362 of the hub plate 332 spin with the motor housing 312 and hub plate 332, producing a flow of air. As the fan blades 84 rotate, oscillating vibrations are produced in the fan blades 84 and transferred to the hub plate 332. Additionally, operation of the motor 304 introduces vibrations in the motor housing 312. The vibrations are damped in the radial direction (horizontal in the views of FIGS. 12 and 13) primarily by the middle regions 372 of the grommets 336, which elastically deform within the openings 360 to dampen the transfer of radial vibrations between the fasteners 344 and the hub plate 332.

In the axial direction (vertical in the views of FIGS. 12 and 13), the upper and lower regions 364, 368 of the grommets 336 elastically deform to dampen axial vibrations and movement between the hub plate 332 and the motor housing 312 and between the hub plate 332 and the fasteners 344, particularly the head of each fastener 344. As a result, the transfer of vibrations and movement between the motor 304 and the fan blades 84 is greatly reduced.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the disclosure.

The invention claimed is:

1. A hub assembly for a fan, comprising:

a motor assembly including a motor and a motor housing surrounding the motor, the motor being configured to rotate the motor housing during operation;

a hub supported on the motor housing by a plurality of fasteners; and a plurality of resilient members at least partially interposed between the hub and the motor housing, each resilient member of the plurality of resilient members surrounding a portion of a corresponding fastener of the plurality of fasteners, the plurality of resilient members being in contact with the motor housing and the hub and configured to elastically deform between the motor housing and the hub so as to dampen vibrations and movement therebetween, wherein:

each of the plurality of fasteners includes a head portion and a shaft portion;

the hub includes a first side facing said motor housing and a second side facing away from said motor housing; and the hub assembly further comprises a plurality of resilient spacers that are separate from the plurality of resilient members, each resilient spacer being interposed between the head portion of a respective fastener and the second side of the hub.

2. The hub assembly of claim 1, wherein:

the second side of the hub defines a plurality of recesses;

the hub defines a plurality of openings, each opening of the plurality of openings extending from a corresponding recess of the plurality of recesses to the first side of the hub; and each of the plurality of recesses receives one of the plurality of resilient spacers and the head portion of one of the plurality of fasteners.

3. The hub assembly of claim 2, wherein each of the plurality of resilient spacers includes a first annular portion and a second annular portion, the first annular portion having a greater outer diameter than the second annular portion.

4. The hub assembly of claim 3, wherein the second annular portion of each resilient spacer is positioned in a corresponding opening of the plurality of openings.

5. The hub assembly of claim 1, wherein the plurality of resilient members are formed of an elastomeric material.

6. The hub assembly of claim 1, wherein the hub defines a plurality of threaded openings configured for mounting a plurality of fan blades to the hub such that each of the plurality of fan blades is mounted to two of the plurality of threaded openings that are adjacent and on opposite sides of the resilient members.

7. A vibration isolation system for a ceiling fan, comprising:

a hub configured to be supported on a motor housing of a motor assembly by a plurality of fasteners; and a plurality of resilient members at least partially interposed between the hub and the motor housing, each resilient member of the plurality of resilient members surrounding a portion of a corresponding fastener of the plurality of fasteners, the plurality of resilient members being in contact with the motor housing and the hub and configured to elastically deform between the motor housing and the hub so as to dampen vibrations and movement therebetween, wherein:

each of the plurality of fasteners includes a head portion and a shaft portion;

the hub includes a first side facing said motor housing and a second side facing away from said motor housing; and the vibration isolation system further comprises a plurality of resilient spacers that are separate from the plurality of resilient members, each resilient spacer being interposed between the head portion of a respective fastener and the second side of the hub.

8. The vibration isolation system of claim 7, wherein:

the second side of the hub defines a plurality of recesses;

the hub defines a plurality of openings, each opening of the plurality of openings extending from a corresponding recess of the plurality of recesses to the first side of the hub; and each of the plurality of recesses receives one of the plurality of resilient spacers and the head portion of one of the plurality of fasteners.

9. The vibration isolation system of claim 8, wherein each of the plurality of resilient spacers includes a first annular portion and a second annular portion, the first annular portion having a greater outer diameter than the second annular portion.

10. A fan comprising:

a motor assembly including a motor and a motor housing surrounding the motor, the motor being configured to rotate the motor housing during operation;

a hub supported on the motor housing by a plurality of fasteners;

a plurality of resilient members at least partially interposed between the hub and the motor housing, each resilient member of the plurality of resilient members surrounding a portion of a corresponding fastener of the plurality of fasteners, the plurality of resilient members being in contact with the motor housing and the hub and configured to elastically deform between the motor housing and the hub so as to dampen vibrations and movement therebetween; and a plurality of fan blades supported by the hub, wherein:

each of the plurality of fasteners includes a head portion and a shaft portion;

the hub includes a first side facing said motor housing and a second side facing away from said motor housing; and the fan further comprises a plurality of resilient spacers that are separate from the plurality of resilient members, each resilient spacer being interposed between the head portion of a respective fastener and the second side of the hub.

* * * * *